US006280052B1

(12) United States Patent
White

(10) Patent No.: US 6,280,052 B1
(45) Date of Patent: Aug. 28, 2001

(54) LIGHT DIFFUSER

(75) Inventor: Barry D. White, Newburgh, NY (US)

(73) Assignee: Lightron of Cornwall, Incorporated, New Windsor, NY (US)

( * ) Notice: Subject to any disclaimer, the term of this patent is extended or adjusted under 35 U.S.C. 154(b) by 0 days.

(21) Appl. No.: 09/483,134

(22) Filed: Jan. 13, 2000

(51) Int. Cl.[7] ..... F21V 3/02

(52) U.S. Cl. ..... 362/225; 362/223

(58) Field of Search ..... 326/326, 335, 326/340, 338, 332, 361, 362, 329, 223, 328, 246, 225

(56) References Cited

U.S. PATENT DOCUMENTS

| | | | | |
|---|---|---|---|---|
| 3,647,148 | * | 3/1972 | Wince | 362/223 |
| 4,698,734 | * | 10/1987 | Ngai | 362/225 |
| 4,933,820 | * | 6/1990 | Engel | 362/217 |
| 5,020,252 | * | 6/1991 | De Boef | 40/564 |
| 5,075,827 | * | 12/1991 | Smith | 362/221 |
| 5,746,502 | * | 5/1998 | Huang | 362/223 |
| 6,024,468 | * | 2/2000 | Kassay | 362/260 |

OTHER PUBLICATIONS

Catalog Sheet, LX135 series (wraparound), Tristar Lighting.
Catalog Sheet, Wayfarer Series 88, Lightron of Cornwall, Inc., 4 pp.

* cited by examiner

*Primary Examiner*—Alan Cariaso
*Assistant Examiner*—Hargobind S. Sawhney
(74) *Attorney, Agent, or Firm*—Fish & Richardson P.C.

(57) ABSTRACT

A light diffuser for directing light emitted from an elongated lamp toward an area desired to be illuminated, includes a curved member that is positioned between the lamp and the area desired to be illuminated. The curved member is generally parallel to a longitudinal axis of the lamp and is symmetric about a plane that extends through the longitudinal axis. The curved member includes a first curved portion on one side of the plane of symmetry and a second curved portion on the other side of the plane of symmetry. The first curved portion extends from a first end to a second end. The first end is disposed adjacent the plane of symmetry and spaced from the lamp while the second end is disposed adjacent the lamp and spaced from the plane of symmetry. The second curved portion extends from a first end to a second end. The first end of the second curved portion is disposed adjacent the plane of symmetry and adjacent the first end of the first curved portion. The second end of the second curved portion is disposed adjacent the lamp and spaced from the plane of symmetry.

26 Claims, 9 Drawing Sheets

CATALOG NUMBER: SERIES 89-132 - 'THE POINT'
LUMINAIRE: FORMED STEEL HOUSING, FORMED WHITE ENAMEL STEEL REFLECTORS WITH FORMED SPECULAR ALUMINUM REFLECTOR ABOVE LAMP. CLEAR ACRYLIC PRISMATIC LENS.
LAMP: ONE PHILIPS F32T8/TL841 RATED AT 2850 LUMENS.
BALLAST: ONE ADVANCE REL-1P32-SC
MOUNTING: SURFACE
LUMEN TO CANDELA RATIO USED = 9.15
TOTAL INPUT WATTS = 30.1 AT 120.0 VOLTS
THE 0 DEGREE PLANE IS PARALLEL WITH THE LAMPS.

CANDELA DISTRIBUTION

| | 0.0 | 22.5 | 45.0 | 67.5 | 90.0 | FLUX |
|---|---|---|---|---|---|---|
| 0 | 564 | 564 | 564 | 564 | 564 | |
| 5 | 560 | 563 | 564 | 559 | 559 | 53 |
| 15 | 534 | 538 | 537 | 534 | 535 | 152 |
| 25 | 484 | 484 | 492 | 497 | 507 | 228 |
| 35 | 414 | 417 | 445 | 494 | 512 | 285 |
| 45 | 325 | 332 | 409 | 469 | 494 | 313 |
| 55 | 224 | 264 | 363 | 439 | 468 | 317 |
| 65 | 135 | 214 | 330 | 423 | 457 | 313 |
| 75 | 62 | 163 | 299 | 406 | 446 | 297 |
| 85 | 12 | 112 | 263 | 380 | 421 | 265 |
| 90 | 1 | 92 | 242 | 358 | 399 | |
| 95 | 0 | 55 | 186 | 301 | 340 | 192 |
| 105 | 0 | 8 | 48 | 103 | 122 | 61 |
| 115 | 0 | 0 | 1 | 4 | 7 | 4 |
| 125 | 0 | 0 | 0 | 0 | 0 | 0 |
| 135 | 0 | 0 | 0 | 0 | 0 | 0 |
| 145 | 0 | 0 | 0 | 0 | 0 | 0 |
| 155 | 0 | 0 | 0 | 0 | 0 | 0 |
| 165 | 0 | 0 | 0 | 0 | 0 | 0 |
| 175 | 0 | 0 | 0 | 0 | 0 | 0 |
| 180 | 0 | 0 | 0 | 0 | 0 | |

ZONE LUMEN SUMMARY

| ZONE | LUMENS | % LAMP | % FIXT |
|---|---|---|---|
| 0 - 30 | 433 | 15.2 | !7.5 |
| 0 - 40 | 718 | 25.2 | 29.0 |
| 0 - 60 | 1347 | 47.3 | 54.3 |
| 0 - 90 | 2222 | 78.0 | 89.6 |
| 90 - 120 | 258 | 9.0 | 10.4 |
| 90 - 130 | 258 | 9.0 | 10.4 |
| 90 - 150 | 258 | 9.0 | 10.4 |
| 90 - 180 | 258 | 9.0 | 10.4 |
| 0 - 180 | 2480 | 87.0 | 100.0 |

TOTAL LUMINAIRE EFFICIENCY: 870.0%
CIE TYPE: SEMI-DIRECT
PLANE: 0-DEG 90-DEG
SPACING CRITERIA: 1.2 1.4

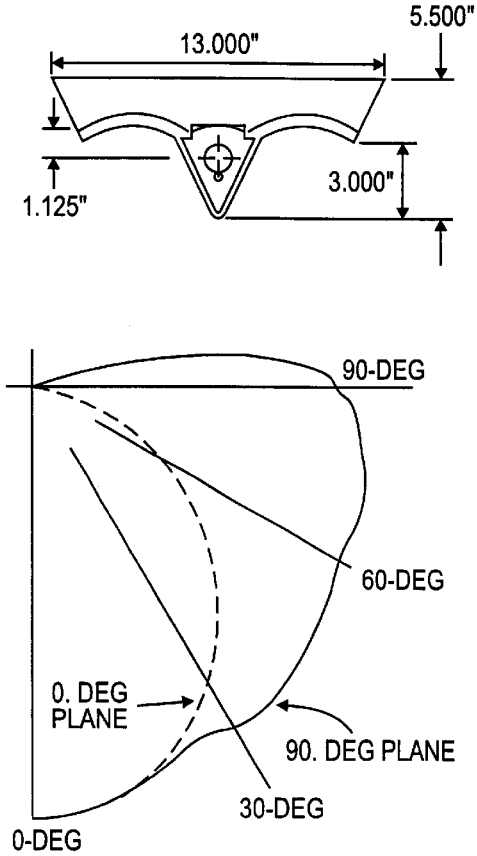

FIG. 8

LIGHT DIFFUSER

BACKGROUND OF THE INVENTION

The invention relates to light diffusers.

In a fluorescent lamp, phosphor crystals are coated on the inner surface of a glass envelope containing a mercury vapor. The lamp includes a cathode for generating electrons which bombard the vapor and generate ultraviolet light. The ultraviolet light causes the phosphor crystals to emit visible light in both radial and tangential directions of the glass envelope. Because it is generally desired that the light be directed to particular areas, reflectors are generally used to help direct the emitted light to the target areas.

A typical fluorescent lighting system, for example, has a housing, referred to as a troffer for supporting one or more fluorescent tubular lamps, as well the necessary wiring and electrical hardware for providing power to the lamps. The troffer generally has a box-like structure and is often used as a reflector. Light rays incident on the side and rear portions of the troffer are either absorbed or reflected by the surface. The inner surfaces of the troffer are typically painted white in order to decrease the amount of light absorbed by the surfaces.

With rising energy costs, efforts are being made to improve the optical efficiency of lighting systems. The optical efficiency represents the total amount of light directed to an area relative to the total amount of light generated by the lamp.

SUMMARY OF THE INVENTION

The invention relates to a light diffuser for efficiently directing light emitted from an elongated lamp toward an area desired to be illuminated.

In one general aspect of the invention, the light diffuser includes a curved member positioned between the lamp and the area desired to be illuminated and having a particular configuration. The curved member is generally parallel to a longitudinal axis of the lamp and is symmetric about a plane that extends through the longitudinal axis. The curved member includes a first curved portion, on one side of the plane of symmetry, extending from a first end to a second end. The first end is disposed adjacent the plane of symmetry and spaced from the lamp while the second end is disposed adjacent the lamp and spaced from the plane of symmetry. The curved member also includes a second curved portion on an opposite side of the plane of symmetry extending from a first end to a second end. The first end of the second curved portion is disposed adjacent the plane of symmetry and adjacent the first end of the first curved portion. The second end of the second curved portion is disposed adjacent the lamp and spaced from the plane of symmetry.

Because the diffuser is positioned between the lamp and the area desired to be illuminated, the lamp is hidden from view. Thus, the lighting system has an aesthetically more pleasing appearance. The diffuser increases the lighting efficiency of the lamp and diffuses light relatively uniformly in vertical and horizontal directions.

In another general aspect of the invention, a lighting system includes a first lighting unit having the diffuser described above, the lamp, and a troffer for housing the lamp, and the diffuser. The troffer includes an attachment for removably attaching the diffuser and a reflector that reflects light towards the area desired to be illuminated. The lamp is positioned between the reflector and the diffuser to direct light that would otherwise be directed elsewhere to the area desired to be illuminated, thereby increasing the overall lighting efficiency.

Embodiments of these aspects of the invention may include one or more of the following features. At least one of the first curved portion and the second curved portion of the diffuser defines a convex face oriented towards the lamp. Each of the curved portions defines a convex face oriented towards the lamp. The convex face is defined by a polynomial equation, such as a parabolic equation. The parabolic equation may define an ellipse centered off the axis of symmetry. The curved member includes a prismatic material that includes linear prisms. The curved member is formed of a material including plastic, such as a methacrylate.

The curved portions result in a diffusion efficiency that is greater than 80%, preferably. The curved portions also diffuse light relatively equally in vertical and horizontal directions. The diffuser of claim 1 wherein the directing of light is relatively uniform in all directions.

The curved member includes an attachment device for removably attaching the curved member to a troffer which houses the lamp. The attachment device includes a cavity defined by the second end of the first member. The cavity is configured to removably engage an attachment lip of the troffer. This construction allows the diffuser to be used with standard troffers that are commonly used in lighting systems.

The plane of symmetry either extends through the area desired to be illuminated or is transverse to it. The reflector is curved and defines a substantially concave face oriented towards the lamp. The shape of the reflector results in substantially uniform horizontal and vertical distribution of light from the lighting system.

In one particular embodiment, the lighting system includes a second lighting unit positioned adjacent to the first lighting system. The lighting first lighting unit is oriented such that the plane of symmetry of the first lighting unit lies along the plane of symmetry of the second lighting unit. The first end of the first portion of the first lighting unit is oriented in an opposite direction to a corresponding first end of a first portion of the second lighting unit.

In an alternative embodiment, the lighting system is oriented such that the first end of the first portion of the first unit is oriented in substantially the same direction as a corresponding first end of a first portion of the second lighting unit. The plane of symmetry of the first lighting unit lies parallel to the plane of symmetry of the second lighting unit.

In either case, the two lamps increase the total lighting in the area that is desired to be illuminated. The orientation of the two lamps also maintains the efficiency and the uniform horizontal and vertical distribution of light from the two lamps.

In yet another general aspect of the invention, a method of forming a diffuser for directing light toward an area desired to be illuminated, includes the following steps. A curved member is formed to include a first curved portion and a second curved portion, symmetric to the first curved portion about a plane of symmetry. The curved member is formed so that it is generally parallel about a longitudinal axis. The first curved portion is formed so that it extends from a first end to a second end. The first end is formed so that it is disposed adjacent the plane of symmetry while the second end is formed so that it is spaced from the plane of symmetry. The second curved portion is formed so that it extends from a first end to a second end. The first end of the second curved portion is formed so that it is disposed adjacent the plane of symmetry and adjacent the first end of the first curved portion. The second end of the second curved portion is formed so that it is spaced from the plane of symmetry.

Embodiments of the aspect of the invention may include one or more of the following. The curved portion is formed from a material including plastic (e.g. methacrylate) by extrusion. The second end of the first portion is formed to define a cavity for engaging the diffuser to a troffer by receiving a troffer attachment lip.

Other advantages and features of the invention will become apparent from the following description and the claims.

BRIEF DESCRIPTION OF THE DRAWING

FIG. 8 shows illumination test results for the diffuser of FIG. 1.

DETAILED DESCRIPTION

Figure 1:
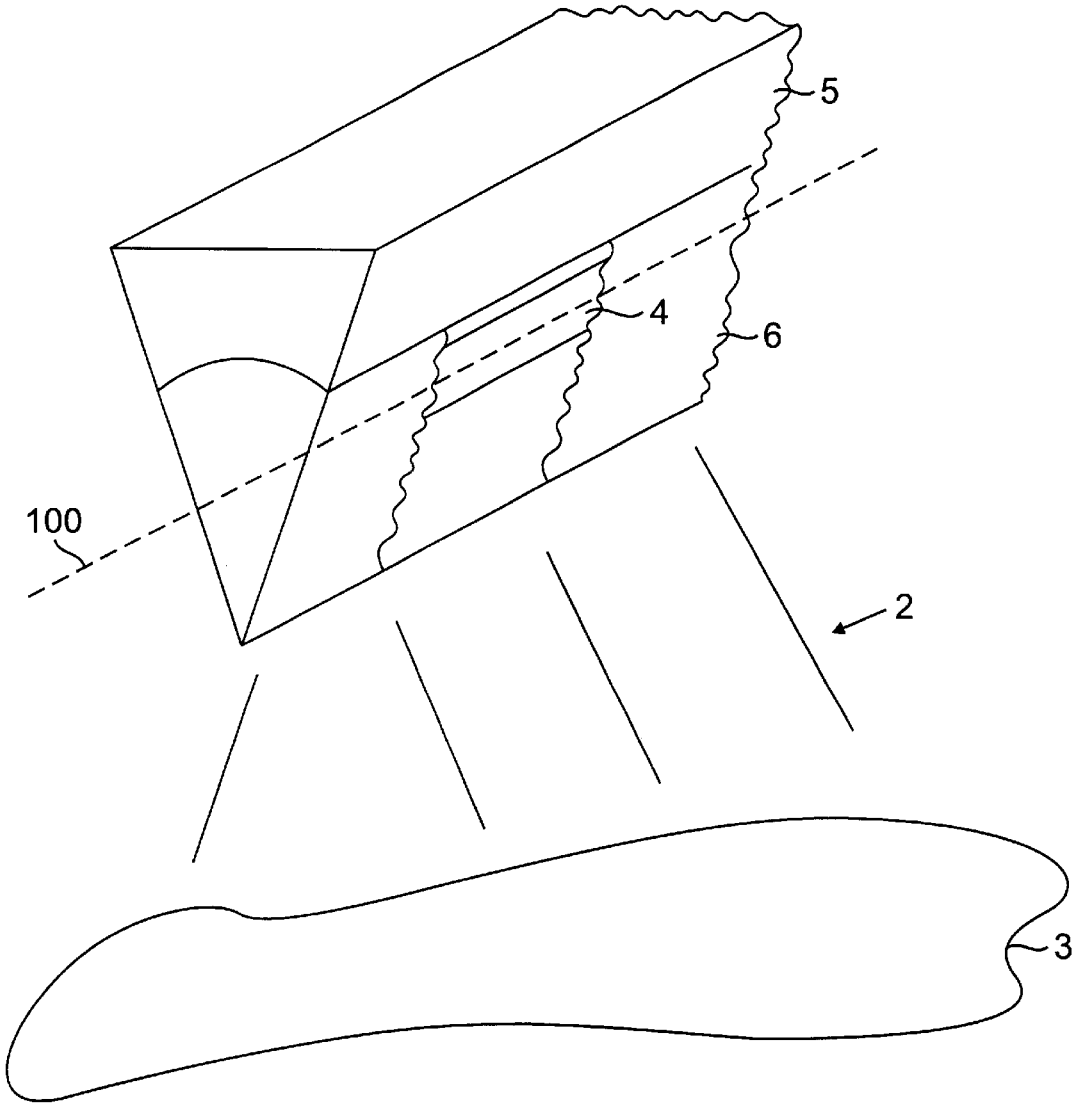
FIG. 1 is a perspective view of a portion of a lighting system having a diffuser according to the invention.
Figure 2:
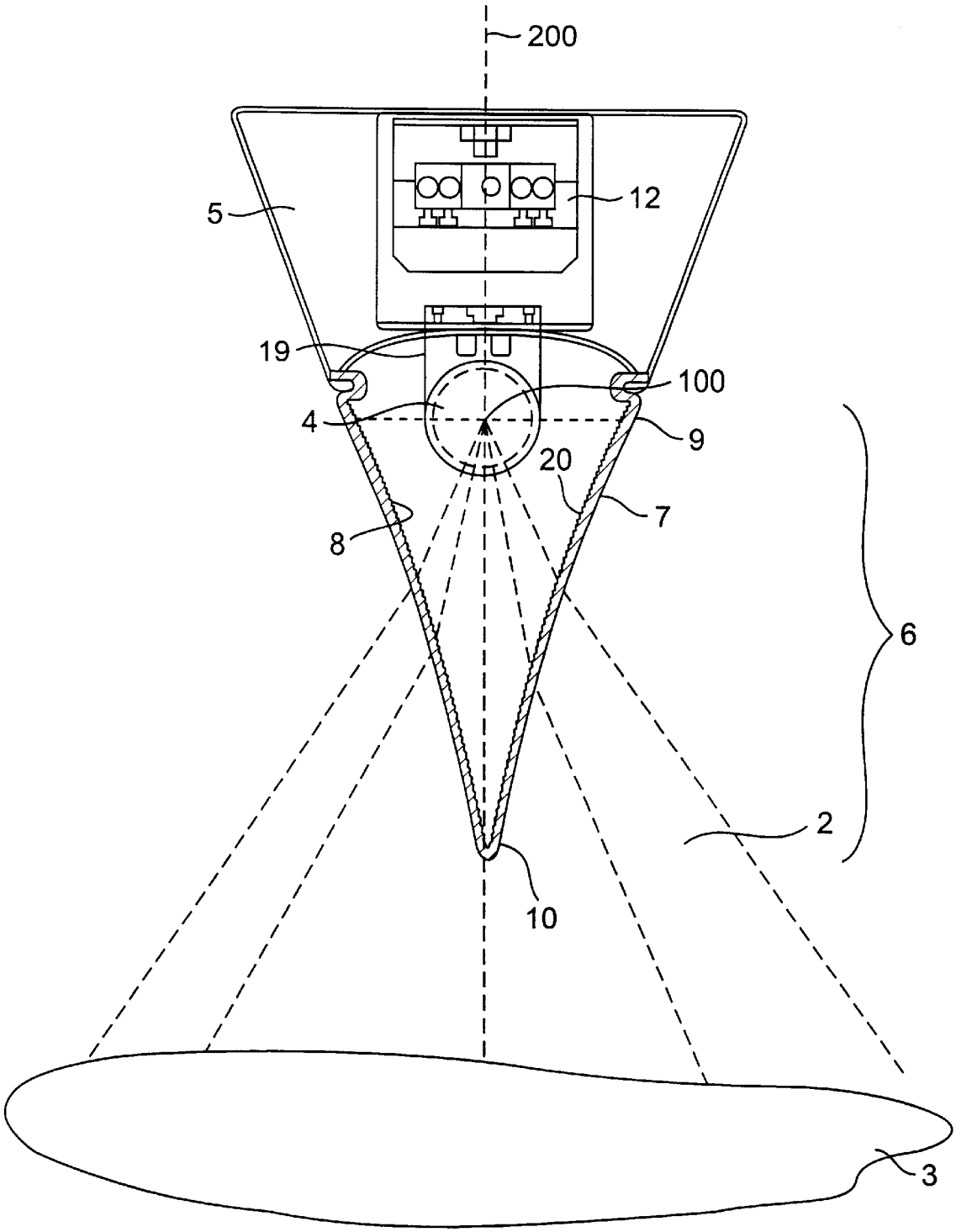
FIG. 2 is a cross-sectional of the lighting system of FIG. 1.

Referring to FIGS. 1 and 2, a lighting system 1 for illuminating an area 3 includes a standard troffer 5 for housing a standard fluorescent lamp 4. Troffer 5 defines an internal volume for housing a ballast 12 which provides the proper starting voltage to the lamp 4 via a receptacle 19 used to mount the lamp. The lamp 4 is elongated about a longitudinal axis 100 and generates light 2 which is directed to the area 3 by a substantially V-shaped diffuser 6 (shown partially cut away in FIG. 1 to show the lamp 4). The diffuser 6 is positioned between the lamp and the area 3 to be illuminated by attaching it to the troffer 5.

Referring in particular to FIG. 2, the narrow end 10 of the diffuser and the longitudinal axis 100 of the lamp 4 define a plane 200, which bisects lamp 4, diffuser 6, and troffer 5 into symmetric halves. The plane of symmetry 200 divides the diffuser into a right half 7 and a symmetric left half 8. Because the two halves 7, 8 are, in this embodiment, symmetric, only the right half 7 will be described.

The right half 7 of the diffuser 6 extends from a narrow end 10 of the diffuser toward the lamp and away from the plane of symmetry 200 to a right end 9, thereby defining a convex face 20 that is oriented towards the lamp 4.

Figure 3A:
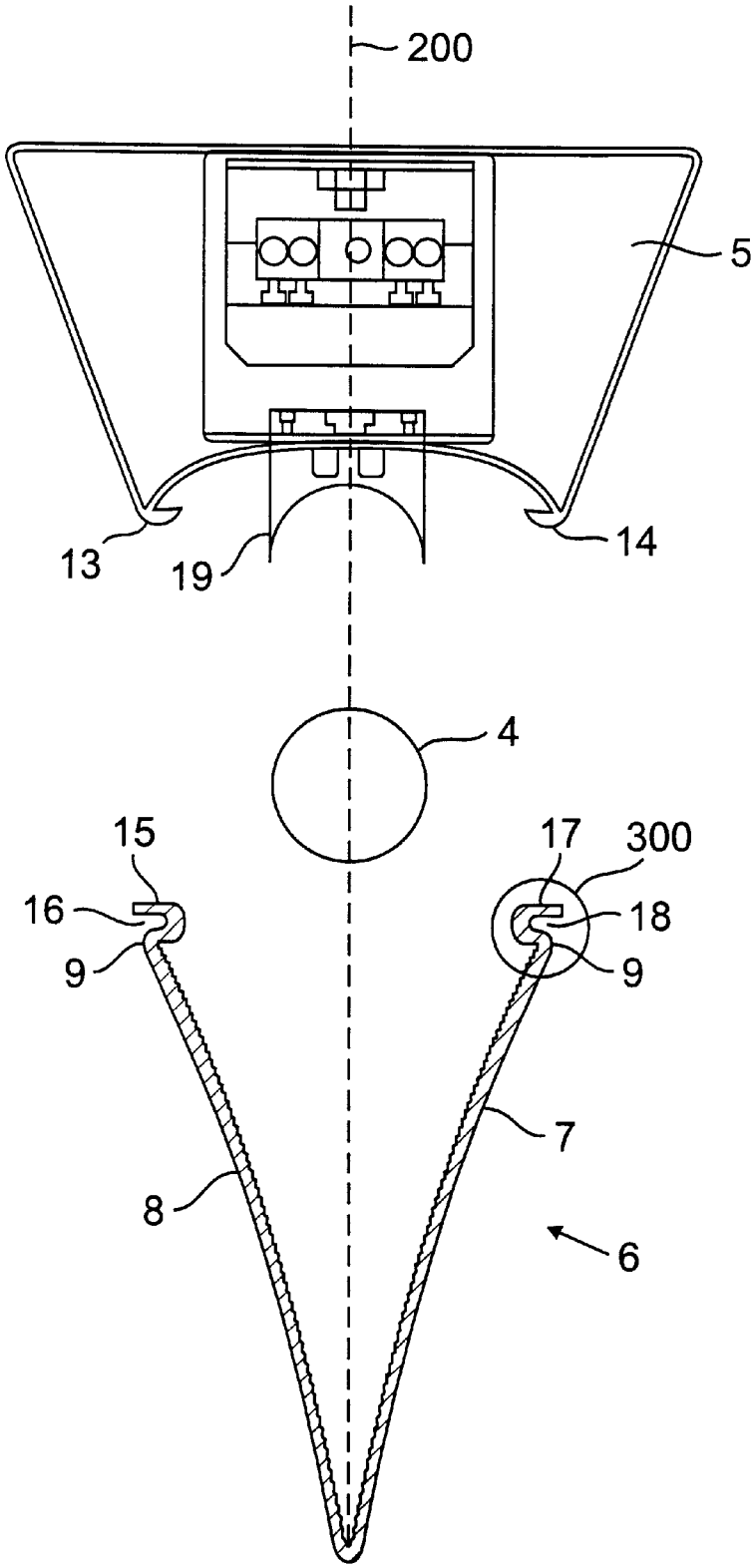
FIG. 3A is an exploded view of FIG. 2.

Referring to FIG. 3A, the lamp 4 and the diffuser 6 can be attached and detached from the troffer 5. Ends 9 of the diffuser 6 are bent into "U" shaped loops 17, 15 to allow the diffuser 6 to be attached to the standard troffer 5. Loops 15, 17 respectively define openings 16, 18 that receive troffer attachment lips 13, 14, when the diffuser 6 is pushed against the troffer 5. Thus, the diffuser 6 can be attached to a standard troffer 5 by pushing loops 15 and 17 against lips 13, 19 until the openings 16, 18 engage the lips 13, 19. To detach a diffuser 6 from a troffer 5 (as shown in FIG. 2), the two halves 7, 8 of the diffuser 6 are pushed towards each other until at least one of the openings 16, 18 of the diffuser 6 is disengaged from its corresponding attachment lip 13, 14 of the troffer 5. The diffuser is then extracted from the troffer. The diffuser material and its thickness are chosen so that the two halves can be pushed together to disengage the lips.

Figure 3B:
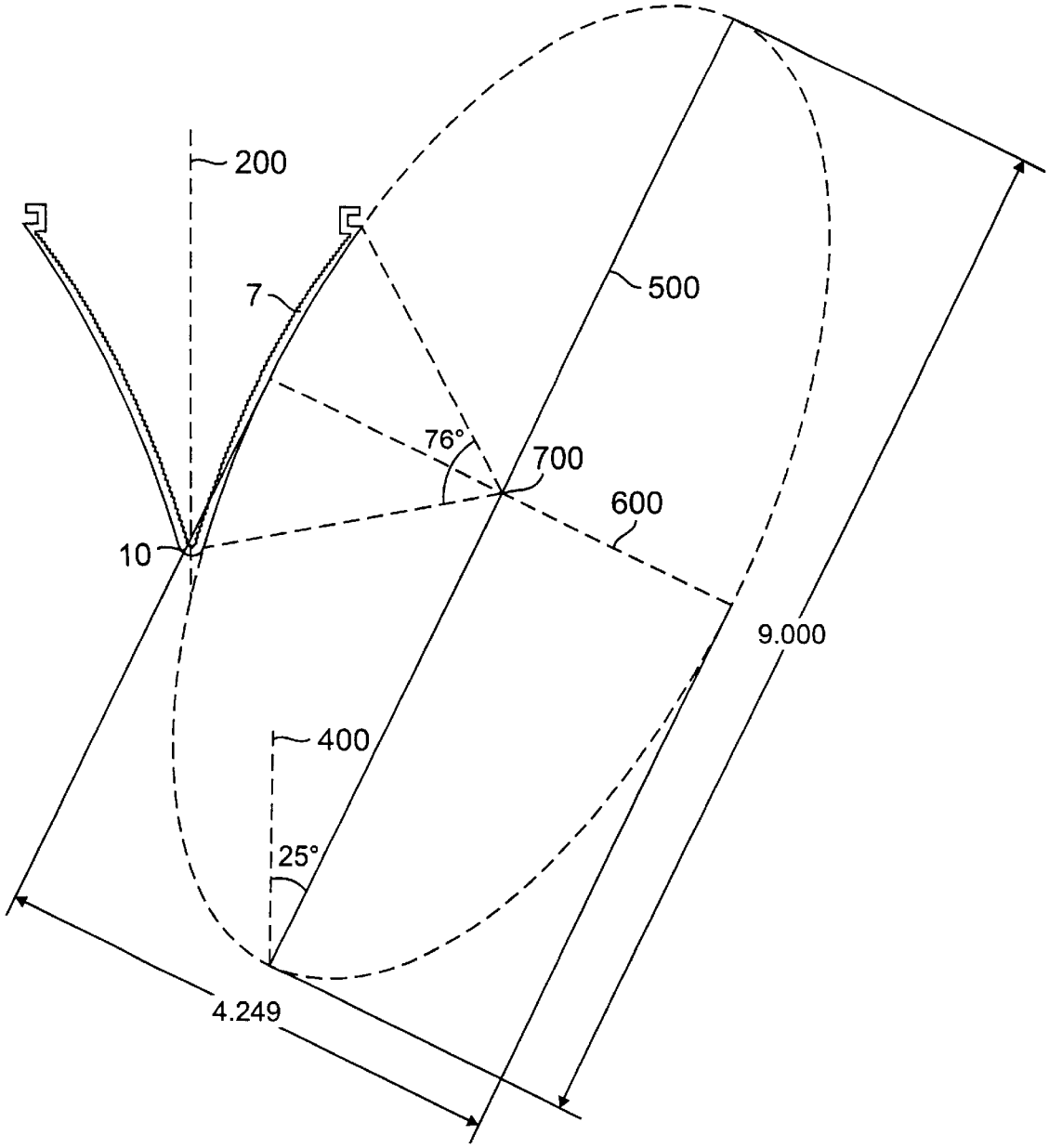
FIG. 3B illustrates the geometric derivation of a portion of the diffuser of FIG. 1.

Referring to FIG. 3B, the right half 7 of the diffuser 6 defines a segment of an ellipse 800 that is centered about a point 700, to the right of the axis of symmetry 200. In this embodiment, the right half 7 projects an angle of seventy six degrees to the center point 700. The minor axis 600 of the ellipse 800 bisects the right half 7 of the diffuser and has a length of 4.249 inches. The major axis 500 of the ellipse 800 is at an angle of twenty five degrees to the axis of symmetry 200 and has a length of 9 inches. Diffuser 6 having this shape provides a high diffusion efficiency, while distributing the light uniformly in both vertical and horizontal directions.

The diffuser is constructed by extruding pellets of methacrylate material in the symmetric curved shape 6 of FIGS. 3A and 3B. Suitable methacrylate pellets may be purchased from Cyro Industries, 100 enterprise Dr., P.O. Box 5055, Rockaway N.J. 07866.

Figure 4:
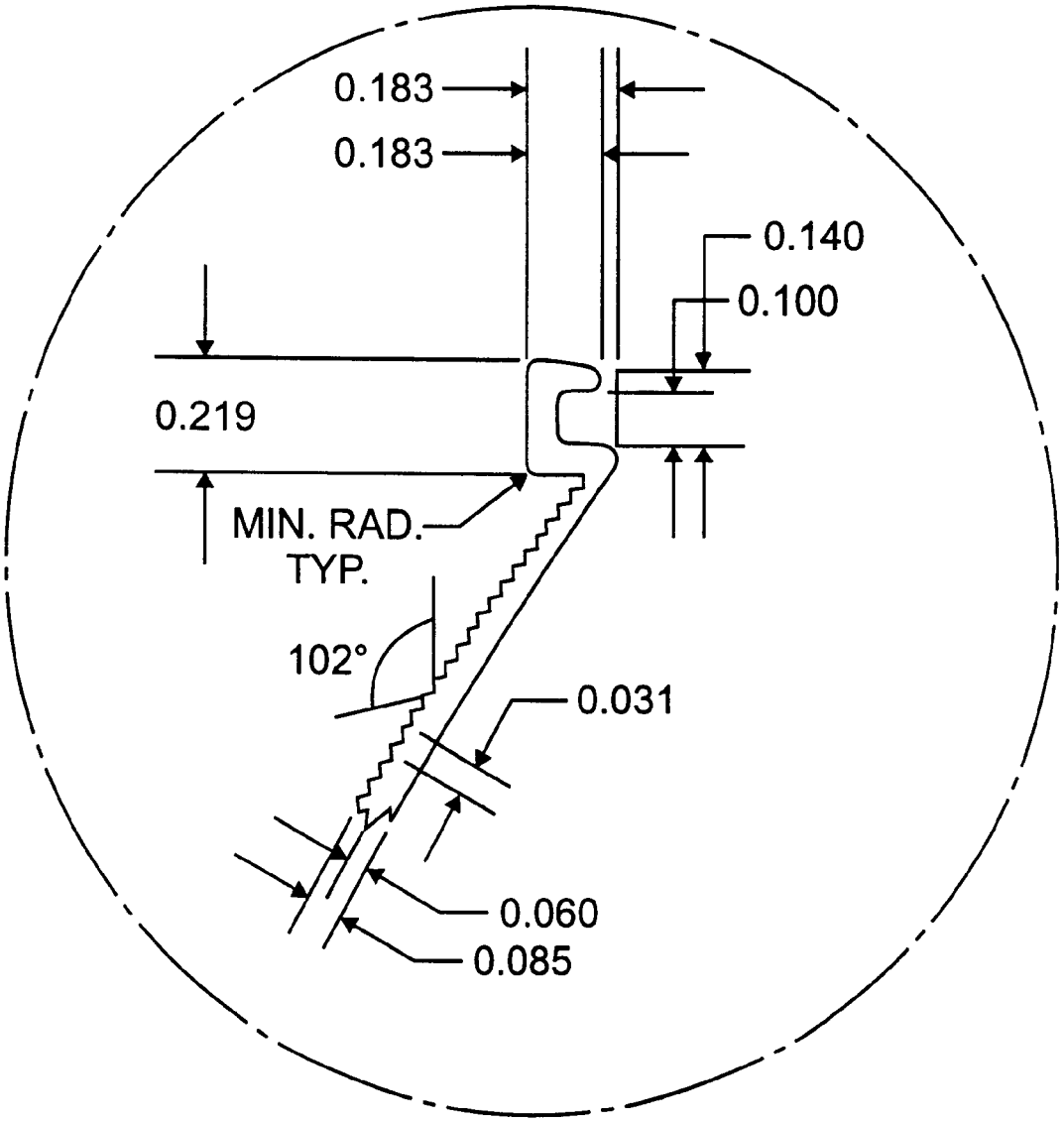
FIG. 4 is a magnified view of a section of the diffuser of FIG. 1.

Referring to FIG. 4, a blown up section 300 from FIG. 3A shows prisms P formed on the inner surface 50 of the diffuser 6 during the extrusion process. The prisms have a height of 0.025 inches and are separated by a distance of 0.031 inches. The prisms have adjacent surfaces S1 and S2 at an angle of 102 degrees to each other. The prisms obscure the lamp image, resulting in aesthetically appealing lighting while also directing the light from lamp 4 uniformly along the axis 200 of symmetry and perpendicular to the axis of symmetry. The light intensity at different angles θ (shown in FIG. 3A) is relatively the same.

The efficiency of the diffuser is measured by using a goniophotometer to compare the light energy from the diffuser at a given angle with the light energy from an unshielded light source, as specified by the Illuminating Engineering Society standard LM-41-98. Tests from an independent test agency (Luminaire Testing Laboratory, 905 Harrison St., Allentown, P.a. 18103) have measured the efficiency of the diffuser at 87% when used with an aluminum reflector. The test results are included in FIG. 8.

Figure 5:
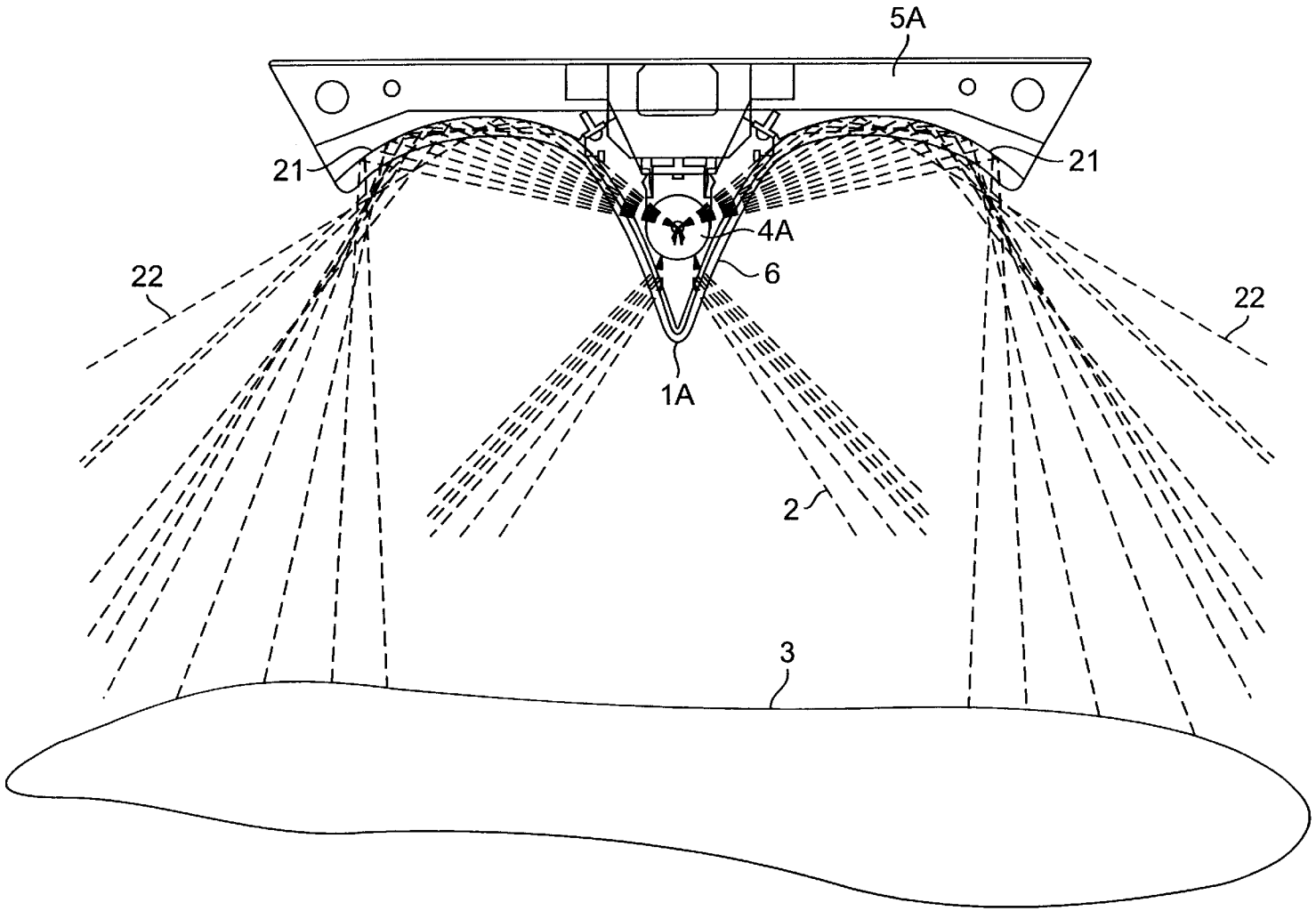
FIG. 5 is a cross-sectional view of an alternative embodiment of a lighting system having a reflector and a diffuser according to the invention.

Referring to FIG. 5, the diffuser 6 can be used with a standard troffer 5A that is equipped with parabolic reflectors 21 on either side of the lamp 4A. The reflectors 21 define a concave reflective surface that is oriented towards the area 4 desired to be illuminated. The surface is constructed with specular aluminum or another reflective material. The parabolic reflectors are positioned in the troffer 5A such that the lamp 4A is closer to the area 3 that is to be illuminated than the reflectors. In addition to the diffuser 6 directing light 2, the parabolic reflectors 21 direct light 22 to the area 3 that is to be illuminated. But for the reflectors 21, the directed light 22 would not have illuminated the area 3. Thus, the reflectors 21 increase the efficiency of the lighting system.

Figure 6:
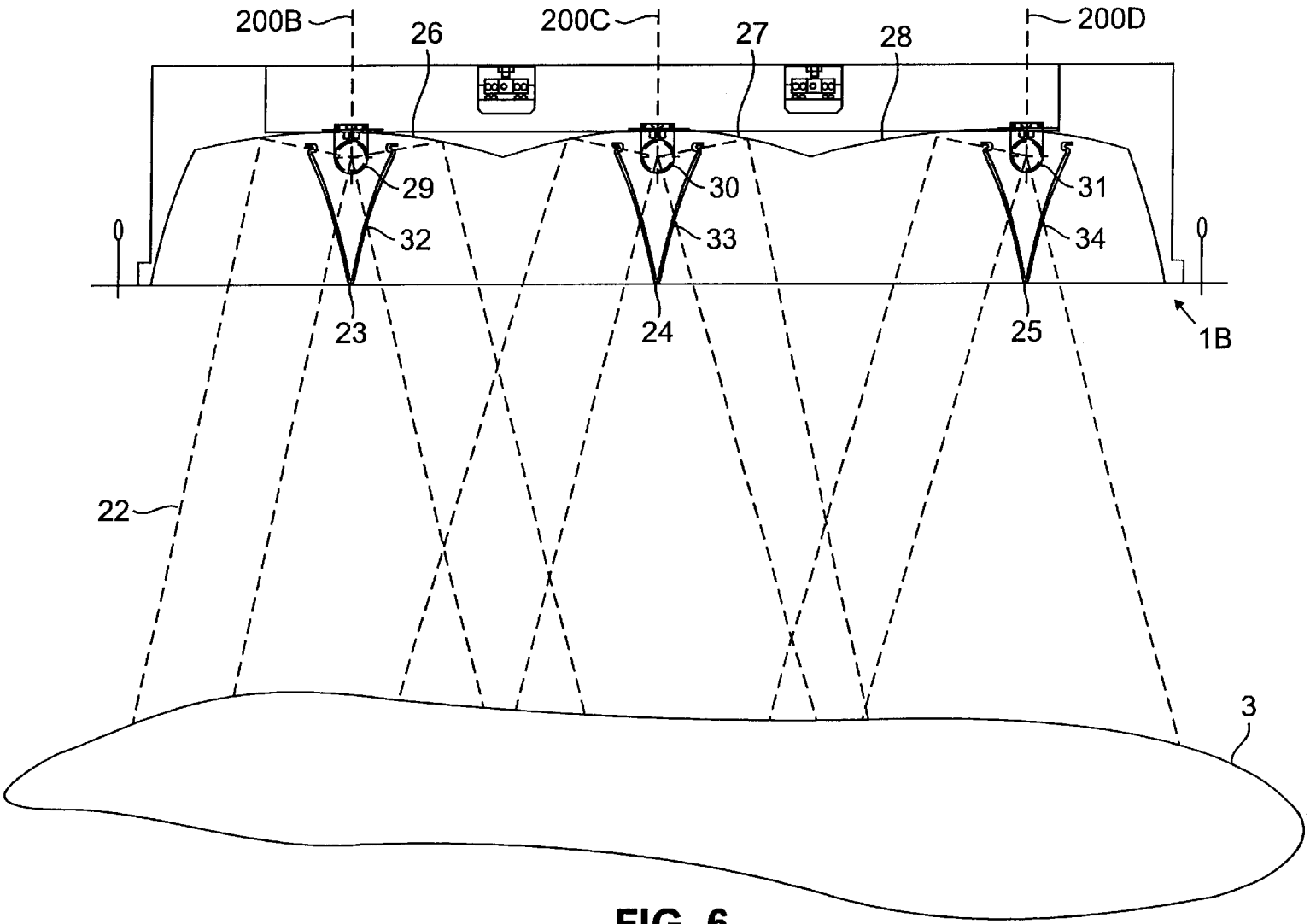
FIG. 6 is a cross-sectional view of an alternative embodiment of a lighting system having three diffusers according to the invention.

Referring to FIG. 6, lighting system 1B has three separate diffusers 32–34, each associated with a respective lamp 29–31 and a respective reflector 26–28. The diffusers have their narrow ends 23–25 oriented so that they generally point towards the area 3 that is to be illuminated. The planes 200B, 200C, 200D of symmetry of the diffusers 32, 33, 34, respectively, are parallel to each other. The reflectors 26–28 are positioned such that the lamps 29–31 lie between the reflectors 26–28 and the area 3 that is to be illuminated. The reflectors reflect light 22, that would otherwise not be used to illuminate the area 3, to area 3. Alternatively, different numbers of diffuser-lamp sets can be used in different embodiments to provide the lighting needed in area 3.

Figure 7:
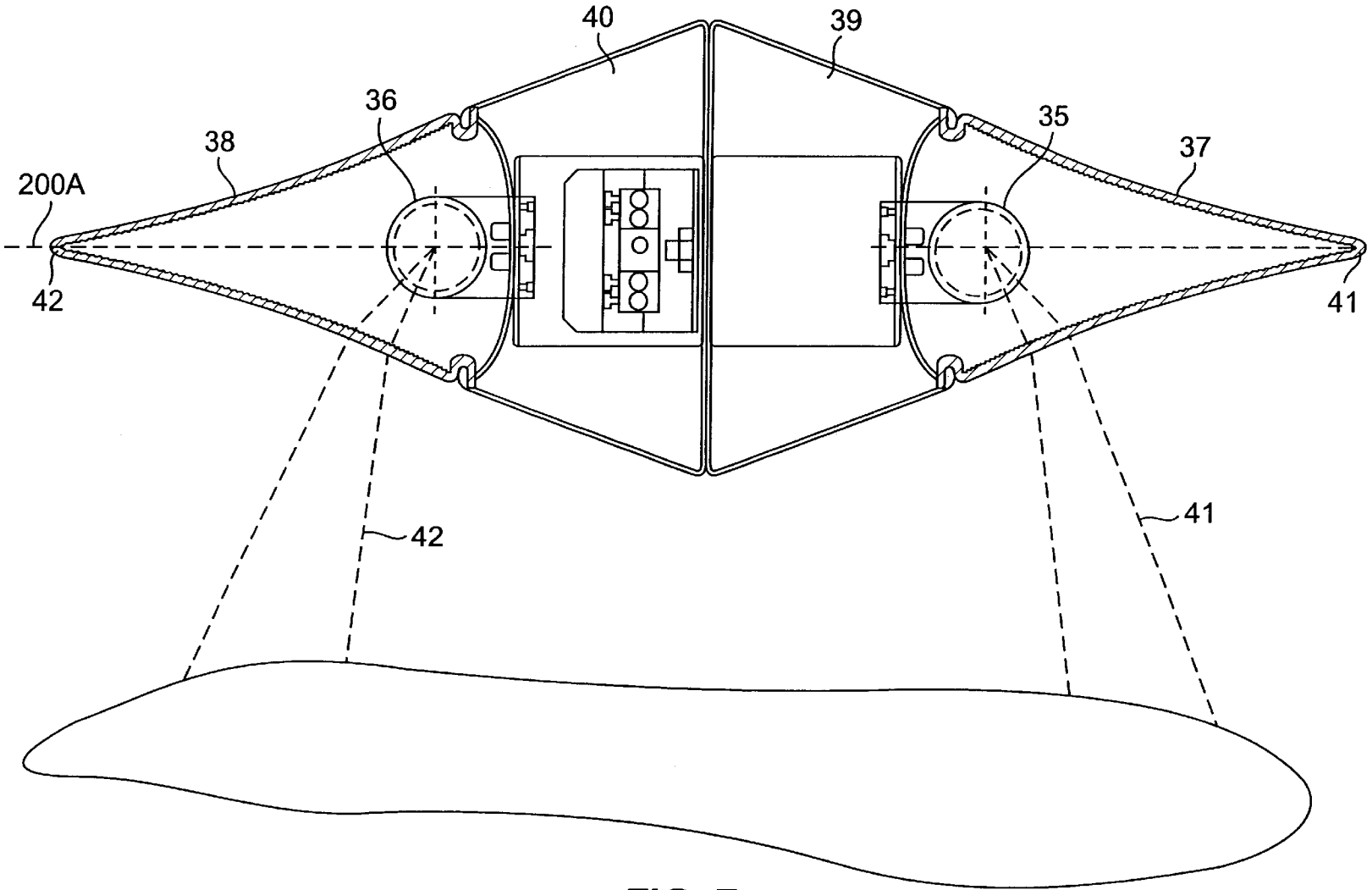
FIG. 7 is a cross-sectional view of another alternative lighting system having two diffusers according to the invention.

Referring to FIG. 7, the diffusers 37, 38 can be used in a lighting system that has two troffers 39, 40 that are oriented back to back. The two troffers 39, 40 have corresponding lamps 35, 36 which illuminate the area 3 by providing light 41, 42. The diffusers are oriented such that the narrow end 42 of the first diffuser 38 is oriented in an opposite direction to the narrow end 41 of the second diffuser 37. The diffusers 37, 38 are symmetric about the same plane 200A. This configuration provides lighting both above and below the lighting system.

Other embodiments are within the scope of the following claims. For example, the diffuser could be constructed from other materials, such as polycarbonates. The concave surface of the diffuser could be defined by a function that is convex over the surface but is not necessarily parabolic (e.g. a polynomial, or a sinusoid). The diffuser can also be used with different kinds of troffer configurations.

Other embodiments may have a diffuser with a shape that is similarly curved to the diffuser of FIG. 3B but is not defined by a mathematical ellipse. Such a diffuser will achieve similar results.

What is claimed is:

1. A light diffuser for directing light emitted from a lamp toward an area desired to be illuminated, the lamp being elongated along a longitudinal axis, said light diffuser comprising:

a curved member that is positioned between the lamp and the area desired to be illuminated, the curved member being generally parallel to the longitudinal axis and symmetric about a plane that extends through the longitudinal axis, the curved member including:

a first curved portion on one side of said plane of symmetry, said first curved portion extending from a first end, disposed adjacent the plane of symmetry and spaced from the lamp, to a second end, disposed adjacent the lamp and spaced from the plane of symmetry, and a second curved portion on an opposite side of said plane of symmetry, said second curved portion extending from a first end of the second curved portion to a second end of the second curved portion disposed adjacent the lamp and spaced from the plane of symmetry, the first end of the second curved portion being disposed adjacent the plane of symmetry and adjacent the first end of the first curved portion, wherein at least one of said first curved portion and said second curved portion defines a convex face oriented towards the lamp.

2. The light diffuser of claim 1 wherein each of said curved portions define a convex face oriented towards the lamp.

3. The light diffuser of claim 1 wherein said convex face is defined by a polynomial equation.

4. The light diffuser of claim 3 wherein the polynomial equation is parabolic.

5. The light diffuser of claim 4 wherein the equation defines an ellipse centered off the axis of symmetry.

6. The diffuser of claim 1 wherein each of said curved portions defines a segment of an ellipse centered about a point spaced from the longitudinal axis, such that the curved portions direct light relatively equally in horizontal and vertical directions.

7. The light diffuser of claim 1 wherein the curved member is formed of a material including plastic.

8. The light diffuser of claim 7 wherein the plastic includes methacrylate.

9. The light diffuser of claim 1 wherein the curved member comprises a prismatic material.

10. The light diffuser of claim 9 wherein said prismatic material includes linear prisms.

11. The light diffuser of claim 1 wherein said curved member further including an attachment device for removably attaching said curved member to a troffer, which houses the lamp.

12. The light diffuser of claim 11 wherein said attachment device includes a cavity defined by said second end of said first member, said cavity being configured to removably engage an attachment lip of the troffer.

13. The light diffuser of claim 1, wherein the plane of symmetry extends through the area desired to be illuminated.

14. The light diffuser of claim 1, wherein the plane of symmetry is transverse to the area desired to be illuminated.

15. The diffuser of claim for directing light emitted from a lamp toward an area desired to be illuminated, the lamp being elongated along a longitudinal axis, said light diffuser comprising:

a curved member that is positioned between the lamp and the area desired to be illuminated, the curved member being generally parallel to the longitudinal axis and symmetric about a plane that extends through the longitudinal axis, the curved member including:

a first curved portion on one side of said plane of symmetry, said first curved portion extending from a first end, disposed adjacent the plane of symmetry and spaced from the lamp, to a second end, disposed adjacent the lamp and spaced from the plane of symmetry, and a second curved portion on an opposite side of said plane of symmetry, said second curved portion extending from a first end of the second curved portion to a second end of the second curved portion disposed adjacent the lamp and spaced from the plane of symmetry, the first end of the second curved portion being disposed adjacent the plane of symmetry and adjacent the first end of the first curved portion, at least one of the said first curved portion and said second curved portion defines a convex face oriented towards the lamp, wherein said curved portions result in a diffusion efficiency that is greater than 80%.

16. The diffuser of claim 15 wherein each of said curved portions defines a segment of an ellipse centered about a point spaced from the longitudinal axis, such that the curved portions direct relatively equally in horizontal and vertical directions.

17. A lighting system for directing light toward an area desired to be illuminated, said lighting system comprising a first lighting unit, including:

a lamp for generating the light, the lamp being elongated along a longitudinal axis for generating the light;

a diffuser including a curved member that is positioned between the lamp and the area desired to be illuminated, the curved member being generally parallel to the longitudinal axis and symmetric about a plane that extends through the longitudinal axis, the curved member including:

a first curved portion on one side of said plane of symmetry, said first curved portion extending from a first end, disposed adjacent the plane of symmetry and spaced from the lamp, to a second end, disposed adjacent the lamp and spaced from the plane of symmetry, and a second curved portion on an opposite side of said plane of symmetry, said second curved portion extending from a first end of the second curved portion to a second end of the second curved portion disposed adjacent the lamp and spaced from the plane of symmetry, the first end of the second curved portion being disposed adjacent the plane of symmetry and adjacent the first end of the first curved portion at least one of said first curved portion and said second curved portion defining a convex face oriented towards the lamp; and a troffer for housing the lamp, the troffer including:

an attachment for removably attaching the diffuser to the troffer, a reflector that reflects light towards the area desired to be illuminated, the reflector being positioned so that the lamp is located between the reflector and the curved member, the curved reflector being symmetrical about the plane of symmetry.

18. The lighting system of claim 17 wherein said reflector is curved.

19. The lighting system of claim 17 wherein the reflector defines a substantially concave face oriented towards the lamp.

20. The lighting system of claim 17 further comprising a second lighting unit positioned adjacent to the first lighting unit, the second lighting unit being similar to the first lighting unit.

21. The lighting system of claim 20 further oriented such that the plane of symmetry of the first lighting unit lies along a plane of symmetry of the second lighting unit, the first end of the first portion of the first lighting unit being oriented in an opposite direction to a corresponding first end of a first portion of the second lighting unit.

22. The lighting system of claim 20 further oriented such that the plane of symmetry of the first lighting unit lies parallel to a plane of symmetry of the second lighting unit, the first end of the first portion being oriented in substantially the same direction as a corresponding first end of a first portion of the second lighting unit.

23. A method of forming a diffuser for directing light toward an area desired to be illuminated, the method comprising:

forming a curved member so that it includes a first curved portion and a second curved portion, symmetric to the first curved portion about a plane of symmetry, said curved member being formed so that it is generally parallel about a longitudinal axis, forming the first curved portion so that it extends from a first end, disposed adjacent the plane of symmetry, and a second end, second end spaced from the plane of symmetry, and forming the second curved portion so that it extends from a first end, disposed adjacent the plane of symmetry, to a second end, spaced from the plane of symmetry, the first end of the second curved portion being disposed adjacent the first end of the first curved portion, the second end of the second curved portion being spaced from the plane of symmetry;

wherein at least one of the said first curved portion and said second curved portion defines a convex face oriented towards the lamp.

24. The method of claim 23 wherein said curved portion is formed from methacrylate.

25. The method of claim 23 wherein said curved portion is formed by extrusion.

26. The method of claim 23 further comprising:

forming said second end of said first portion to define a cavity for engaging said diffuser to a troffer by receiving a troffer attachment lip.

* * * * *